US010059557B2

(12) United States Patent
Yokoya et al.

(10) Patent No.: US 10,059,557 B2
(45) Date of Patent: Aug. 28, 2018

(54) POST-PROCESSING APPARATUS AND IMAGE FORMING SYSTEM

(71) Applicant: CANON KABUSHIKI KAISHA, Tokyo (JP)

(72) Inventors: Takashi Yokoya, Yoshikawa (JP); Akinobu Nishikata, Abiko (JP); Yutaka Ando, Toride (JP); Akihiro Arai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/197,896

(22) Filed: Jun. 30, 2016

(65) Prior Publication Data

US 2017/0036882 A1 Feb. 9, 2017

(30) Foreign Application Priority Data

Aug. 4, 2015 (JP) ..... 2015-154500

(51) Int. Cl.
*B65H 43/00* (2006.01)
*B65H 43/06* (2006.01)
*B65H 31/10* (2006.01)

(52) U.S. Cl.
CPC ..... *B65H 43/06* (2013.01); *B65H 31/10* (2013.01); *B65H 2511/152* (2013.01); *B65H 2511/30* (2013.01); *B65H 2511/51* (2013.01); *B65H 2511/515* (2013.01); *B65H 2511/52* (2013.01); *B65H 2601/271* (2013.01); *B65H 2801/06* (2013.01)

(58) Field of Classification Search
CPC ..... B65H 43/06; B65H 2511/152; B65H 2601/271; B65H 260/24
See application file for complete search history.

(56) References Cited

U.S. PATENT DOCUMENTS 6,339,685 B1 1/2002 Okamoto et al.
7,878,495 B2 2/2011 Nishimura et al.
(Continued)

FOREIGN PATENT DOCUMENTS

JP 2-270762 A 11/1990
JP 3-013454 A 1/1991

OTHER PUBLICATIONS

U.S. Appl. No. 15/200,098, filed Jul. 1, 2016.

*Primary Examiner* — Howard J Sanders
(74) *Attorney, Agent, or Firm* — Fitzpatrick, Cella, Harper & Scinto

(57) ABSTRACT

To prevent sheets from being allowed to be delivered after activation of a system when over-stacking has been detected before the activation of the system, a post-processing apparatus includes a stacking tray configured to allow sheets subjected to predetermined processing to be stacked thereon. The post-processing apparatus determines whether or not additional sheets are allowed to be stacked onto the stacking tray based on the number of sheets stacked on the stacking tray. The determination result indicating that the additional sheets are prohibited to be stacked onto the stacking tray is stored in a nonvolatile RAM. The post-processing apparatus determines, after being activated, whether or not the determination result is stored in the nonvolatile RAM, and determines that the additional sheets are prohibited to be stacked onto the stacking tray when the determination result is stored in the nonvolatile RAM.

13 Claims, 9 Drawing Sheets

(56) References Cited

U.S. PATENT DOCUMENTS

| | | | | |
|---|---|---|---|---|
| 8,177,215 | B2 * | 5/2012 | Ohkawa | G03G 15/50 270/58.07 |
| 8,393,372 | B2 | 3/2013 | Yamauchi et al. | |
| 8,413,978 | B2 | 4/2013 | Watanabe et al. | |
| 8,439,340 | B2 | 5/2013 | Maenishi et al. | |
| 8,628,073 | B2 | 1/2014 | Watanabe et al. | |
| 9,079,743 | B2 | 7/2015 | Ando et al. | |
| 2006/0180999 | A1 * | 8/2006 | Suzuki et al. | 271/176 |
| 2014/0020533 | A1 | 1/2014 | Watanabe et al. | |
| 2015/0239705 | A1 * | 8/2015 | Matsunaga | B65H 43/06 |

* cited by examiner

| SHEET TYPE | PLAIN SHEET |
|---|---|
| POST-PROCESSING | N/A |
| OVER-STACKING DETECTION METHOD | DETERMINED BASED ON HEIGHT OF SHEETS |
| LIMIT NUMBER OF SHEETS [SHEET] | – |
| LIMIT NUMBER OF BUNDLES [BUNDLE] | – |
| LIMIT HEIGHT [mm] | 300 |
| INFORMATION TO BE STORED | STORE RESULT THAT OVER-STACKING HAS BEEN DETECTED BASED ON HEIGHT OF SHEETS |

| SHEET TYPE | THICK SHEET |
|---|---|
| POST-PROCESSING | N/A |
| OVER-STACKING DETECTION METHOD | DETERMINED BASED ON NUMBER OF SHEETS |
| LIMIT NUMBER OF SHEETS [SHEET] | 1000 |
| LIMIT NUMBER OF BUNDLES [BUNDLE] | – |
| LIMIT HEIGHT [mm] | 200 |
| INFORMATION TO BE STORED | STORE RESULT THAT OVER-STACKING HAS BEEN DETECTED BASED ON NUMBER OF DELIVERED SHEETS |

| SHEET TYPE | PLAIN SHEET |
|---|---|
| POST-PROCESSING | STAPLING |
| OVER-STACKING DETECTION METHOD | DETERMINED BASED ON NUMBER OF STAPLED BUNDLES |
| LIMIT NUMBER OF SHEETS [SHEET] | – |
| LIMIT NUMBER OF BUNDLES [BUNDLE] | 100 |
| LIMIT HEIGHT [mm] | 200 |
| INFORMATION TO BE STORED | STORE RESULT THAT OVER-STACKING HAS BEEN DETECTED BASED ON NUMBER OF DELIVERED BUNDLES |

FIG. 6

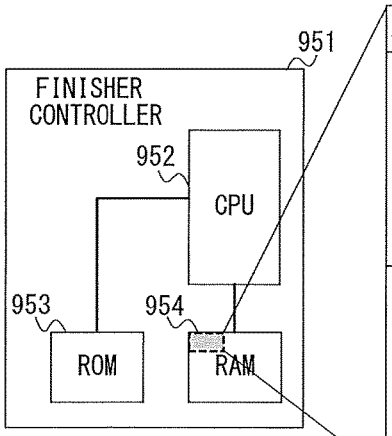

| ADD-RESS | INFORMATION TO BE STORED |
|---|---|
| 0 | STATE IN WHICH OVER-STACKING ON STACKING TRAY 701 HAS BEEN DETECTED<br>0: NORMAL STATE<br>1: OVER-STACKING DETECTED STATE (BASED ON HEIGHT OF SHEETS)<br>2: OVER-STACKING DETECTED STATE (BASED ON NUMBER OF SHEETS)<br>3: OVER-STACKING DETECTED STATE (BASED ON NUMBER OF STAPLED BUNDLES) |
| 1 | STATE IN WHICH OVER-STACKING ON STACKING TRAY 700 HAS BEEN DETECTED<br>0: NORMAL STATE<br>1: OVER-STACKING DETECTED STATE (BASED ON HEIGHT OF SHEETS)<br>2: OVER-STACKING DETECTED STATE (BASED ON NUMBER OF SHEETS)<br>3: OVER-STACKING DETECTED STATE (BASED ON NUMBER OF STAPLED BUNDLES) |

FIG. 7

POST-PROCESSING APPARATUS AND IMAGE FORMING SYSTEM

BACKGROUND OF THE INVENTION

Field of the Invention

The present invention relates to a post-processing apparatus configured to perform a post-processing on sheets discharged from an image forming apparatus, and to an image forming system including the post-processing apparatus and the image forming apparatus.

Description of the Related Art

In the prior art, there has been known a post-processing apparatus, which is arranged with an image forming apparatus, e.g., a copying machine, and is configured to perform post-processing such as punching, stapling, and sorting on sheets conveyed from the image forming apparatus. The post-processing apparatus includes a stacking tray configured to allow the sheets, which are delivered after being subjected to post-processing, to be stacked thereon.

In Japanese Patent Application Laid-open No. Hei 2-270762, there is disclosed a post-processing apparatus configured to perform predetermined post-processing on sheets conveyed from an image forming apparatus, then stack those sheets onto a stacking tray, and raise or lower the stacking tray in accordance with the number of the sheets stacked on the stacking tray.

The post-processing apparatus is configured to detect a height of the sheets stacked on the stacking tray, and determine whether or not the detected height has reached a predetermined height, to thereby detect whether or not over-stacking has occurred, that is, detect whether or not the stacking tray has been fully loaded with the sheets.

In Japanese Patent Application Laid-open No. Hei 3-13454, there is disclosed a post-processing apparatus configured to perform predetermined post-processing on sheets conveyed from an image forming apparatus, then stack those sheets onto a stacking tray, and raise or lower the stacking tray in accordance with the number of the sheets stacked on the stacking tray.

In the post-processing apparatus of Japanese Patent Application Laid-open No. Hei 3-13454, the number of the sheets stacked on the stacking tray is counted, and an obtained count value is compared to a predetermined upper limit number of stacked sheets, to thereby determine whether or not over-stacking has occurred.

In Japanese Patent Application Laid-open No. Hei 2-270762, the height of the stacked sheets is detected to determine whether or not over-stacking has occurred. In Japanese Patent Application Laid-open No. Hei 3-13454, the number of the stacked sheets is detected to determine whether or not over-stacking has occurred.

In the method of Japanese Patent Application Laid-open No. Hei 2-270762, when the power of a system is turned off under a state in which over-stacking has occurred, and thereafter the power is turned on, the height of the sheets is detected again by a stacking tray initialization operation performed at the time of turning the power on. As described above, detection of whether or not the over-stacking has occurred is performed again when the power is turned on. Thus, erroneous detection of the over-stacking does not occur.

However, as in Japanese Patent Application Laid-open No. Hei 3-13454, when a determination as to whether or not over-stacking has occurred is made based on the number of stacked sheets or the number of stacked bundles, there is a case where the determination as to whether or not over-stacking has occurred may not be properly made after turning off or on the power of the system, as described below.

The method of determination based on the number of stacked sheets is employed in the cases of delivering, for example, sheet bundles subjected to stapling, or special sheets having a large basis weight. The sheet bundles subjected to stapling become thicker at stapled portions, and hence stapled end portions of the sheets are swelled as compared to other portions. Thus, when the sheet bundles are stacked to the same stack height as the case of stacking normal sheets, the stacked bundles may be unbalanced and dropped.

In view of the above, in the method of determination based on the number of stacked sheets, the upper limit number of stacked sheets is suppressed to a small value. This is for the purpose of enabling the post-processing apparatus to determine that over-stacking has occurred under a state in which a height of stacked sheets is small as compared to the method of determination based on the stack height of the normal sheets. Further, when special sheets having a large basis weight are continuously stacked to an upper limit stack height set for normal sheets, the weight of a pile of those sheets may exceed a load capacity value of the stacking tray. In this case, the torque of the stacking tray may become insufficient. Thus, also with regard to the special sheets having the large basis weight, it is necessary to determine whether or not over-stacking has occurred based on the number of the delivered sheets.

For example, there is a case where it is not determined that over-stacking has occurred based on the height of stacked sheets but is determined that the over-stacking has occurred based on the number of the stacked sheets, and there is a case where the system is shifted to a power-off mode or a sleep mode under this state. In this case, in the stacking tray initialization operation which is performed, for example, upon turning the power on, the height of the stacked sheets is detected again. However, when the system is powered off, or shifted to the sleep mode or a standby mode, information related to the number of stacked sheets is lost. In addition, the height of the sheets has not reached the upper limit height as described above. Thus, there is a risk in that it is not determined that the over-stacking has occurred even under a state in which the determination that the over-stacking has occurred is required to be made.

As a result, even when the power is turned off or on under a state in which the over-stacking has been detected, the sheets are allowed to be delivered, and hence failures in stacking or malfunction of the stacking tray may be induced.

SUMMARY OF THE INVENTION

In order to solve the above-mentioned problems, according to this disclosure, there is provided a post-processing apparatus, which is to be connected to an image forming apparatus, the post-processing apparatus comprising: a stacking tray configured to allow sheets received from the image forming apparatus to be stacked thereon; a sheet detector configured to detect presence or absence of sheets stacked on the stacking tray; a controller configured to execute a first determination processing for determining whether or not additional sheets are allowed to be stacked onto the stacking tray based on the number of the sheets stacked on the stacking tray; and a storage unit configured to store, as a result of the first determination processing, a first determination result indicating that the additional sheets are prohibited to be stacked onto the stacking tray, the controller being configured to determine that the additional sheets are prohibited to be stacked onto the stacking tray in a case where, after activation of the post-processing apparatus and before reception of the sheets from the image forming apparatus, the sheet detector detects the presence of the sheets stacked on the stacking tray, and the first determination result indicating that the additional sheets are prohibited to be stacked onto the stacking tray is stored in the storage unit.

BRIEF DESCRIPTION OF THE DRAWINGS

FIG. 6 is an explanatory diagram for illustrating details of over-stacking detection determination.

FIG. 7 is an explanatory diagram for illustrating information to be stored in a case of the over-stacking.

DESCRIPTION OF THE EMBODIMENTS

First Embodiment (Entire Configuration)

Figure 1:
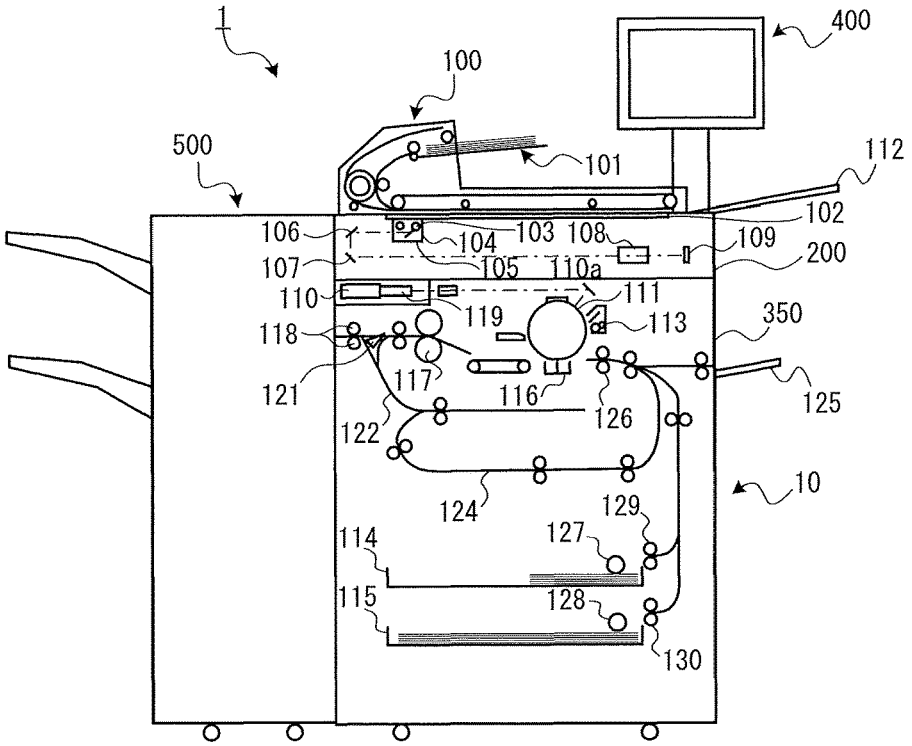
FIG. 1 is a vertical sectional view for illustrating structure of an image forming system to which the present invention is applied.

FIG. 1 is a vertical sectional view for illustrating a structure of a main part of an image forming system 1 according to a first embodiment of the present invention. As illustrated in FIG. 1, the image forming system 1 includes an image forming apparatus 10 and a finisher 500 serving as a post-processing apparatus. Further, in this embodiment, image formation and post-processing are performed on sheets. Types of the sheets to be used are determined through sheet selection. The image forming apparatus 10 includes an image reader 200 configured to read images from originals, a printer 350 configured to form the read images onto the sheets, and a display device 400 configured to present information to a user.

(Main Unit: Reader and Printer)

An original feeder 100 is configured to feed originals, which are set on an original tray 101 so as to have their surfaces to be read facing upward, sequentially one after another from a top page to the left in FIG. 1. The originals are conveyed on a platen glass 102 via a conveying path from the left to the right in FIG. 1 through a predetermined reading position. After that, the originals are delivered onto an external delivery tray 112.

The reading position refers to a predetermined reading position on the platen glass 102 of the image reader 200, and a scanner unit 104 is fixed at this position. When originals pass the reading position on the platen glass 102 from the left to the right, images of the originals are read by the scanner unit 104.

When the original passes the reading position, a surface of the original to be read is irradiated with a light beam from a lamp 103 of the scanner unit 104, and a reflected light beam therefrom is guided by mirrors 105, 106, and 107 toward a lens 108. The light beam transmitted through this lens 108 is imaged on an image pickup surface of an image sensor 109.

When the original is conveyed so as to pass the reading position as described above, original read-scanning is performed with a direction orthogonal to a conveying direction of the original as a main scanning direction and with the conveying direction as a sub-scanning direction. Specifically, when the original passes the reading position, the image sensor 109 reads the image of the original in line units in the main scanning direction. Then, the original is conveyed in the sub-scanning direction. In this way, the scanner unit 104 reads an entirety of the image of the original.

The optically read image is converted into image data by the image sensor 109, and the image data is output therefrom. The image data output from the image sensor 109 is input as a video signal into an exposure unit 110 of the printer 350.

In addition, the original can be read by conveying, by the original feeder 100, the original onto the platen glass 102, stopping the original at a predetermined position, and allowing the scanner unit 104 to scan from the left to the right in this state. Such a reading method is a method so-called original fixed reading.

The exposure unit 110 of the printer 350 modulates a laser beam in response to the video signal input from the image reader 200, and outputs the laser beam. The laser beam is radiated onto a photosensitive drum 111 with a polygonal mirror 110*a*. With this, an electrostatic latent image corresponding to the laser beam is formed on the photosensitive drum 111.

The electrostatic latent image on the photosensitive drum 111 is developed into a visible developer image by developer supplied from a developing unit 113.

Meanwhile, a sheet fed by a pick-up roller 127 or a pick-up roller 128 from an upper cassette 114 or a lower cassette 115 mounted in the printer 350 is conveyed by a sheet feeding roller pair 129 or a sheet feeding roller pair 130 to a registration roller pair 126.

After a leading edge of the sheet reaches the registration roller pair 126, the registration roller pair 126 is driven at an arbitrary timing, and conveys the sheet to a position between the photosensitive drum 111 and a transfer unit 116 at a timing in synchronization with a start of the irradiation of the laser beam.

The developer image formed on the photosensitive drum 111 is transferred onto the fed sheet by the transfer unit 116. The sheet having the developer image transferred thereon is conveyed to a fixing unit 117. The fixing unit 117 is configured to heat and pressurize the sheet to thereby fix the developer image onto the sheet. The sheet having passed through the fixing unit 117 is delivered out of the printer 350 to an outside of the image forming apparatus 10 (to the finisher 500) through a switching flapper 121 and a delivery roller pair 118.

In this case, when the sheet is delivered with its image forming surface facing downward, the sheet having passed through the fixing unit 117 is once guided into a reversal path 122 by a switching operation of the switching flapper 121. After a trailing edge of the sheet passes the switching flapper 121, the sheet is switched back and delivered out of the printer 350 by the delivery roller pair 118. This delivery mode is referred to as reversal delivery.

This reversal delivery is carried out when images are formed sequentially from a top page, such as in a case of forming the images read with use of the original feeder 100 or in a case of forming images output from a computer. With this, the order of the sheets after being delivered is in correct page order.

When a duplex recording mode of performing image formation onto both sides of the sheet is set, the sheet is guided to the reversal path 122 by the switching operation of the switching flapper 121 and thereafter conveyed to a duplex conveying path 124. After that, a control is executed such that the sheet guided to the duplex conveying path 124 is fed again at the above-mentioned timing to a position between the photosensitive drum 111 and the transfer unit 116.

The sheet discharged from the printer 350 of the image forming apparatus 10 is delivered to the finisher 500. A configuration of the finisher 500 is described below.

(Block Diagram of Entire System)

Figure 2:
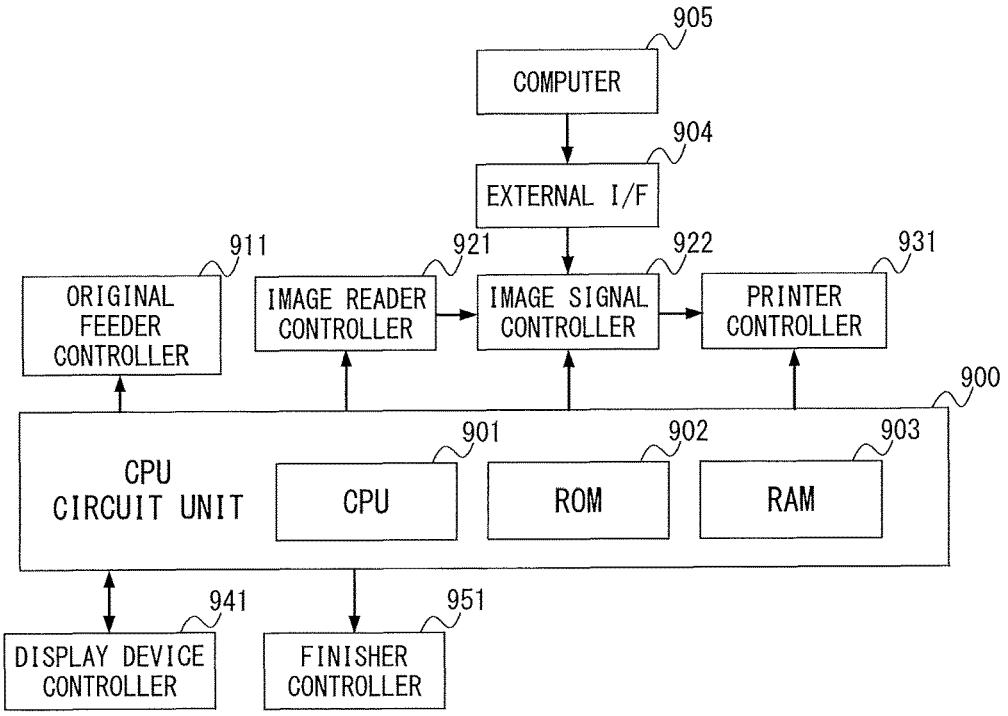
FIG. 2 is a block diagram for illustrating functions of the image forming system.

Next, a configuration of a controller configured to control the entire image forming system 1 of this embodiment and a block diagram of the entire system are described with reference to FIG. 2. FIG. 2 is a block diagram for illustrating the configuration of the controller configured to control the entire image forming system 1 of FIG. 1. All units of the controller, except for a finisher controller 951 described below, are arranged in the image forming apparatus 10.

As illustrated in FIG. 2, the controller includes a CPU circuit unit 900, and the CPU circuit unit 900 includes a CPU 901, a ROM 902, and a RAM 903. The CPU 901 is a CPU configured to execute a basic control over the entirety of the image forming system 1, and the ROM 902 having control programs written therein and the RAM 903 configured to execute processing are connected to the CPU 901 via an address bus and a data bus. In accordance with the control programs stored in the ROM 902, the CPU 901 collectively controls an original feeder controller 911, an image reader controller 921, an image signal controller 922, an external I/F 904, a printer controller 931, a display device controller 941, and the finisher controller 951. The RAM 903 is configured to temporarily store control data, and to be used as a work area for arithmetic processing associated with the control.

The original feeder controller 911 is configured to control driving of the original feeder 100 in response to instructions from the CPU circuit unit 900. The image reader controller 921 is configured to control driving of the scanner unit 104 and the image sensor 109 described above to transfer the image signals output from the image sensor 109 to the image signal controller 922.

The image signal controller 922 is configured to convert analog image signals from the image sensor 109 into digital signals, execute various types of processing on the digital signals so as to convert the digital signals into the video signals, and output the video signals to the printer controller 931. Further, the image signal controller 922 is configured to execute various types of processing on digital image signals output from a computer 905 and input via the external I/F 904 so as to convert the digital image signals into video signals, and output those video signals to the printer controller 931. Those processing operations executed by the image signal controller 922 are controlled by the CPU circuit unit 900. The printer controller 931 is configured to control the exposure unit 110 and the printer 350 in accordance with the input video signals to perform image formation and sheet conveyance.

The finisher controller 951 is mounted in the finisher 500, and configured to control driving of an entirety of the finisher 500 through exchange of information with the CPU circuit unit 900. Details of this control are described below.

The display device controller 941 is configured to allow exchange of information between the display device 400 and the CPU circuit unit 900. The display device 400 includes a plurality of keys for setting various functions associated with the image formation, and a display unit configured to display information indicating current settings. Key signals corresponding to operations to the keys are output to the CPU circuit unit 900, and corresponding information items are displayed on the display device 400 in accordance with the signals from the CPU circuit unit 900.

(Display Device)

Figure 3A:
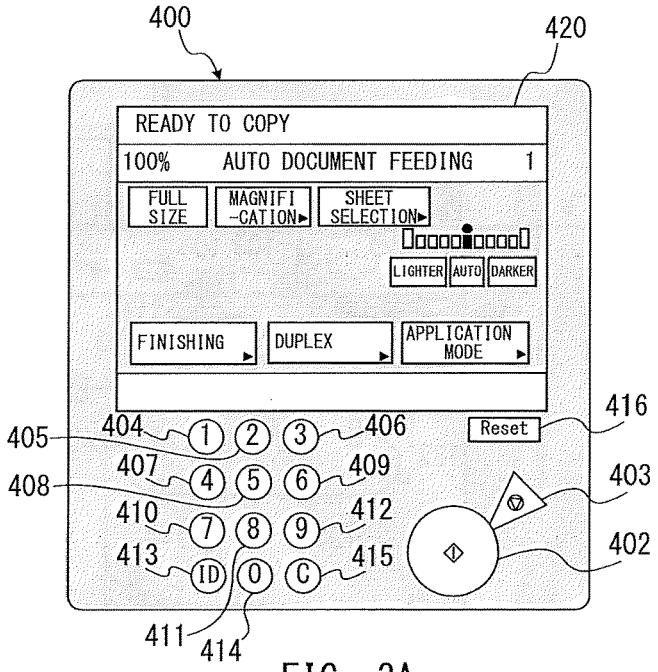
FIG. 3A is an explanatory view for illustrating a display device.

FIG. 3A is an explanatory view for illustrating the display device 400 of the image forming apparatus 10 of FIG. 1. As illustrated in FIG. 3A, in the display device 400, there are arranged a start key 402 for starting an image forming operation, a stop key 403 for interrupting the image forming operation, and numeric keys 404 to 412 and 414 for performing numeric settings and other settings. Further, in the display device 400, there are also arranged an ID key 413, a clear key 415, a reset key 416, and other keys. In an upper portion of the display device 400, a display unit 420 having a touch panel is arranged, and soft keys can be displayed on its screen.

The image forming apparatus 10 has various processing modes such as a non-sort mode, a sort mode, a staple sort mode (binding mode), and a bookbinding mode as post-processing modes. Settings to those processing modes are performed through input operation with the display device 400. Further, the post-processing set on the image forming apparatus 10 side is performed by the finisher 500 serving as the post-processing apparatus.

For example, when the post-processing mode is to be set, selecting the soft key "FINISH" on an initial screen illustrated in FIG. 3A causes a menu selection screen to be displayed on the display unit 420. The settings to the post-processing modes are performed with use of this menu selection screen.

Figure 3B:
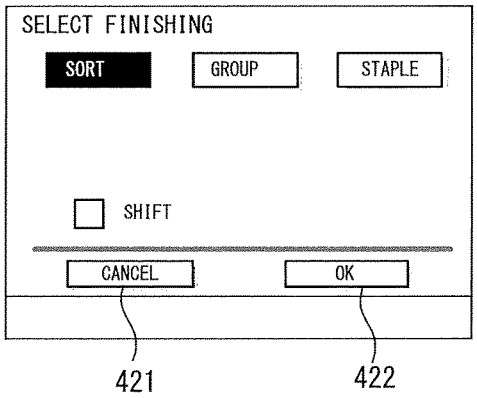
FIG. 3B, FIG. 3C, and FIG. 3D are explanatory views for illustrating operation screens of the display device.
Figure 3C:
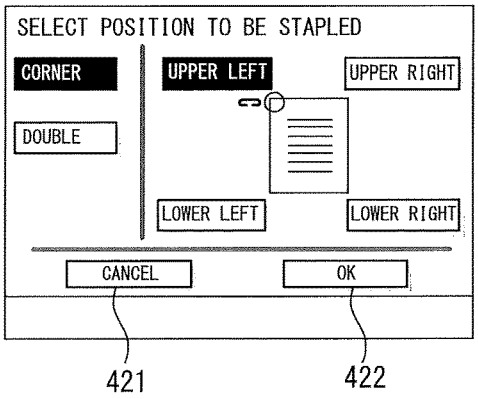

This menu selection screen is illustrated in FIG. 3B. As illustrated in FIG. 3B, on the menu selection screen, soft keys for selecting "SORT," "GROUP," or "STAPLE," and a check box for selecting whether or not to perform shift delivery of the sheets are displayed. In addition, a cancel key 421 for cancelling the settings and an OK key 422 for reflecting the settings are also displayed. As illustrated in FIG. 3B, when a user selects the "SORT" key, and then touches the OK key 422 so as to terminate selection of a finishing process, the sort mode is set. Further, when the user touches the "STAPLE" key, and then touches the OK key 422, the stapling setting screen illustrated in FIG. 3C is displayed on the display unit 420. As illustrated in FIG. 3C, on the stapling setting screen, soft keys for selection of binding methods such as corner binding and two-point binding are displayed. As in FIG. 3B, also in FIG. 3C, the cancel key 421 and the OK key 422 are displayed to enable cancellation of the selection from the binding methods or reflection of settings.

Figure 3D:
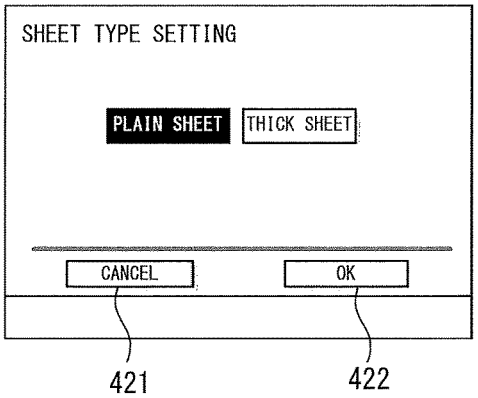

When the soft key "SHEET SELECTION" on the initial screen illustrated in FIG. 3A is selected, the menu selection screen illustrated in FIG. 3D is displayed on the display unit 420. Settings to sheet types are made using this menu selection screen. The user selects a plain sheet or a thick sheet as a type of sheet to be used. As in FIG. 3B, also in FIG. 3D, the cancel key 421 and the OK key 422 are displayed for cancellation of the sheet selection or reflection of settings.

(Finisher)

Figure 4:
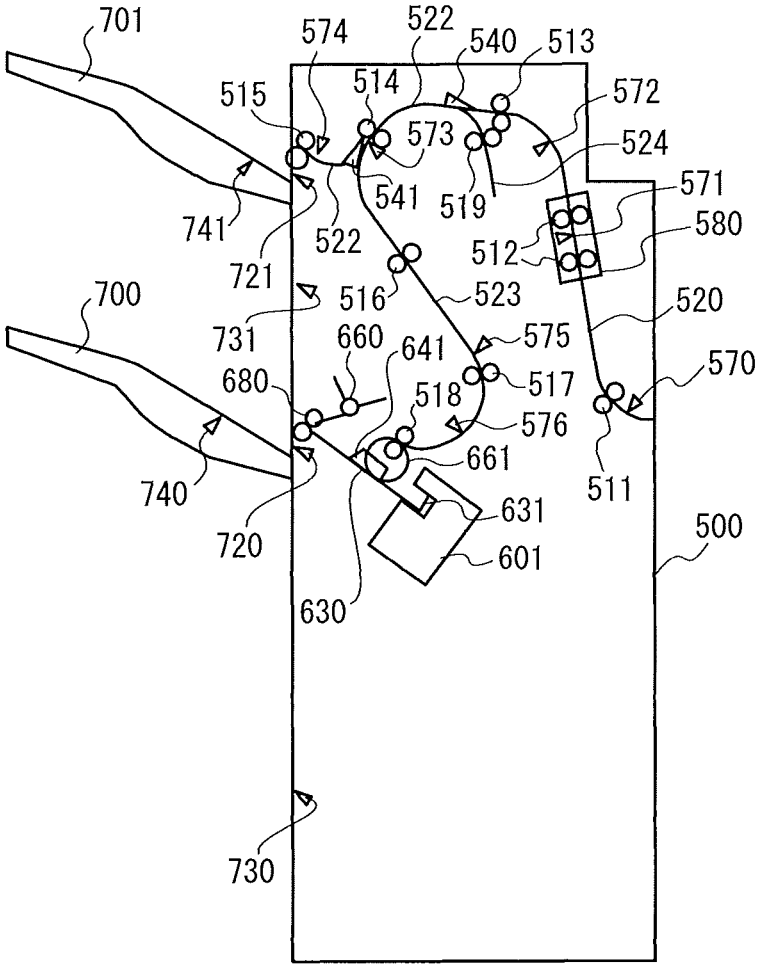
FIG. 4 is an overall sectional view for illustrating a finisher.
Figure 5:
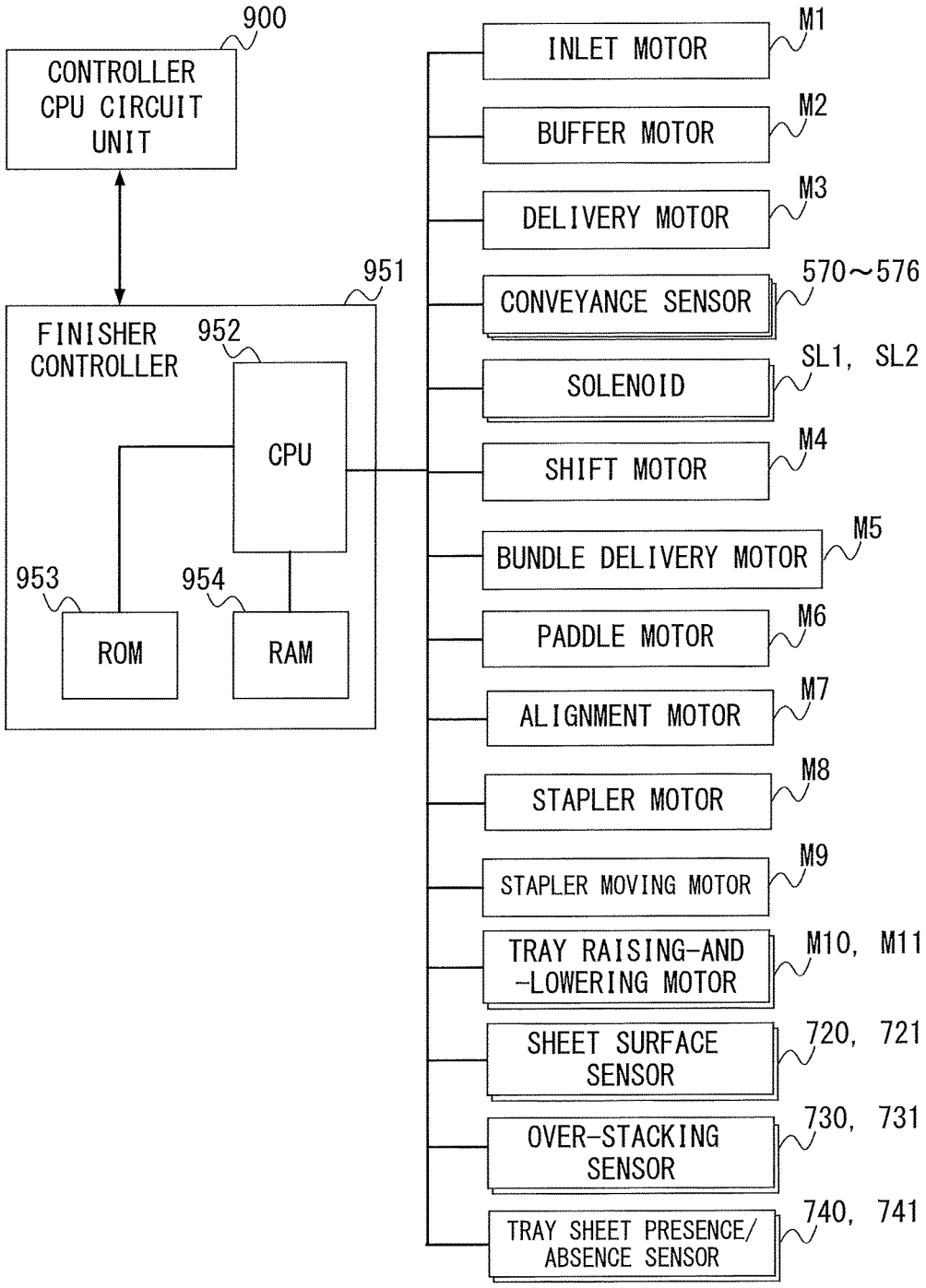
FIG. 5 is a block diagram for illustrating functions of the finisher.

Next, the configuration of the finisher 500 is described with reference to FIG. 4 and FIG. 5. FIG. 4 is a structural view for illustrating the finisher 500 of FIG. 1, and FIG. 5 is a block diagram for illustrating the finisher controller 951 configured to control driving of the finisher 500.

In FIG. 4, the finisher 500 performs various types of post-processing on sheets, such as processing of sequentially taking in a plurality of sheets discharged from the image forming apparatus 10, and aligning and bundling the received sheets into a bundle, and stapling processing for stapling trailing ends of the sheet bundle. Unless otherwise noted, various types of processing and operations of the finisher 500 described below are controlled by the finisher controller 951.

The finisher 500 takes in the sheet discharged from the image forming apparatus 10 into a conveying path 520 with a conveying roller pair 511. The sheet taken in by the conveying roller pair 511 is delivered through conveying roller pairs 512 and 513. In the conveying path 520, there are arranged conveyance sensors 570, 571, and 572 so as to detect passage of the sheet.

The conveying roller pairs 512 are built in a shift unit 580 together with the conveyance sensor 571. The shift unit 580 is moved by a shift motor M4 illustrated in FIG. 5 and described later in a sheet width direction orthogonal to the conveying direction. Under a state in which the conveying roller pairs 512 nip the sheet, the shift motor M4 is driven. With this, the sheet is offset in the width direction while being conveyed. In the sort mode selected by a user through operation of the check box "SHIFT" illustrated in FIG. 3B, the sheet is offset and delivered to any one of a front side (near side) and a rear side (depth side) of the image forming apparatus 10. The sheet is offset by 15 mm to the near side when subjected to the near shift, and by 15 mm to the depth side when subjected to the depth shift. When the "SHIFT" is not selected, the sheet is not offset and allowed to pass as it is.

When the conveyance sensor 571 detects that the sheet has passed through the shift unit 580, the finisher controller 951 causes the shift motor M4 to drive so as to return the shift unit 580 to its center position.

Between the conveying roller pair 513 and a conveying roller pair 514, there is arranged a switching flapper 540 configured to guide sheets, which are to be reversely conveyed by the conveying roller pair 514, toward a buffer path 524. Between the conveying roller pair 514 and a conveying roller pair 515, there is arranged a switching flapper 541 configured to switch conveyance of the sheet to an upper delivery path 522 or to a lower delivery path 523.

When the switching flapper 541 is switched to the upper delivery path 522 side, the conveying roller pair 514 to be driven by a buffer motor M2 illustrated in FIG. 5 causes the sheet to be guided to the upper delivery path 522. After that, the sheet is delivered onto a stacking tray 701 by the conveying roller pair 515 to be driven by a delivery motor M3 illustrated in FIG. 5. In the upper delivery path 522, a conveyance sensor 574 is arranged so as to detect passage of the sheet. For simplified illustration, the buffer motor M2 and the delivery motor M3 are not illustrated in FIG. 4.

When the switching flapper 541 is switched to the lower delivery path 523 side, the conveying roller pair 514 to be driven by the buffer motor M2 causes the sheet to be guided to the lower delivery path 523. After that, the sheet is guided to a processing tray 630 by conveying roller pairs 517 and 518 to be driven by the delivery motor M3 described below. In the lower delivery path 523, conveyance sensors 575 and 576 are arranged so as to detect passage of the sheet.

In accordance with the mode selected in the screen illustrated in FIG. 3B by the user, the sheet is delivered onto the processing tray 630 or a stacking tray 700. When the user selects "STAPLE", the sheet is delivered onto the processing tray 630. When "STAPLE" is not selected, a bundle delivery roller pair 680 to be driven by a bundle delivery motor M5 illustrated in FIG. 5 causes the sheet to be delivered onto the stacking tray 700.

The sheet delivered onto the processing tray 630 is drawn back toward a trailing end side of the conveying direction by a knurled belt 661 to be driven in synchronization with the conveying roller pair 518 and by a paddle 660 to be driven by a paddle motor M6 illustrated in FIG. 5. The sheet thus drawn back is brought into abutment against a stopper 631 and stopped thereat.

An alignment member 641 arranged over the near side and the depth side above the processing tray 630 is moved by an alignment motor M7 illustrated in FIG. 5 in a direction perpendicular to the conveying direction of the sheet. The sheets stacked on the processing tray 630 are subjected to alignment processing by the alignment member 641, and then subjected to stapling and other processing by a stapler 601 when necessary. Then, the sheets on the stacking tray 700 are pressed by a bundle holding-down member to be driven by the bundle holding-down motor (not shown), and a bundle of the sheets is delivered onto the stacking tray 700 by the bundle delivery roller pair 680. Further, the conveyance sensor 576 is arranged near the bundle delivery roller pair 680 so as to detect passage of the sheets. The finisher controller 951 is capable of detecting, with the conveyance sensors 574 and 576, the number of the stacked sheets or the stacked sheet bundles obtained through the stapling, which are stacked onto the stacking trays 701 and 700.

When the sheets are stacked onto the stacking tray 700, a position (height) of an uppermost surface of the sheets stacked on the stacking tray 700 is detected by a sheet surface sensor 720. When the sheet surface sensor 720 is blocked by the stacked sheets, the finisher controller 951 drives a tray raising-and-lowering motor M10 illustrated in FIG. 5 so as to lower the stacking tray 700 to a position at which the sheet surface sensor 720 is not blocked by the stacked sheets. With this, a delivery port and a stacking position are maintained at the same height. When the stacking tray 700 is lowered to a position of a over-stacking sensor 730, the finisher controller 951 notifies the CPU circuit unit 900 of the image forming apparatus 10 of over-stacking as over-stacking detection information. When the over-stacking is notified, the CPU circuit unit 900 determines that additional sheets are not allowed to be stacked onto the stacking tray 700. Thus, in this case, the CPU circuit unit 900 causes the image forming operation of the image forming apparatus 10 to be temporarily stopped until the sheets on the stacking tray 700 are removed.

Meanwhile, when the sheets are stacked onto the stacking tray 701, a position (height) of an uppermost surface of the sheets stacked on the stacking tray 701 is detected by a sheet surface sensor 721. When the sheet surface sensor 721 is blocked by the stacked sheets, the finisher controller 951 drives a tray raising-and-lowering motor M11 illustrated in FIG. 5 so as to lower the stacking tray 701 to a position at which the sheet surface sensor 721 is not blocked by the stacked sheets. With this, a delivery port and a stacking position are maintained at the same height. When the stacking tray 701 is lowered to a position of a over-stacking sensor 731, the finisher controller 951 notifies the image forming apparatus 10 of over-stacking. With this, the image forming operation is temporarily stopped until the sheets on the stacking tray 701 are removed.

The stacking trays 700 and 701 are provided with tray sheet presence/absence sensors 740 and 741 serving as sheet detection units, respectively. Those tray sheet presence/absence sensors 740 and 741 are used so as to determine whether or not the sheets are stacked on the stacking trays 700 and 701.

(Details of Sheet Surface Detection Operation)

Next, the sheet surface detection operation described above is described in detail with reference to FIG. 4 and FIG. 5. Herein, an operation is described which is performed at the time when the sheets are stacked on the stacking tray 700.

A CPU 952 of the finisher controller 951 illustrated in FIG. 5 lowers the stacking tray 700 such that the sheet surface sensor 720 illustrated in FIG. 4 is always OFF, that is, the top surface of the stacked sheets is not detected.

When stacking of sheets onto the stacking tray 700 proceeds, and the sheet surface sensor 720 is turned on (under a state in which the top surface of the stacked sheets is detected), the CPU 952 drives the tray raising-and-lowering motor M10 so as to lower the stacking tray 700.

When the sheet surface sensor 720 is turned off, the CPU 952 stops the driving of the tray raising-and-lowering motor M10 so as to stop the lowering of the stacking tray 700.

Further, when the sheets stacked on the stacking tray 700 are removed by the user, and the tray sheet presence/absence sensor 740 is turned off, the CPU 952 drives the tray raising-and-lowering motor M10 so as to raise the stacking tray 700.

When the sheet surface sensor 720 is turned on again, the CPU 952 stops the driving of the tray raising-and-lowering motor M10 so as to stop the raising of the stacking tray 700. After that, the stacking tray 700 is lowered by driving the tray raising-and-lowering motor M10 until the sheet surface sensor 720 is turned off.

In this way, the CPU 952 performs the sheet surface detection operation such that a distance between the delivery port for the sheets and the top surface of an uppermost sheet of the stacked sheets is always maintained. The stacking tray 701 is operated in the same way. Further, the sheet surface detection operation is performed also at the time of activation of the image forming system 1 including the image forming apparatus 10 and the finisher 500. In this embodiment, activation patterns such as activation from a power-off state and activation from a sleep mode or a power-saving mode are collectively referred to as "activation".

As in the configuration described above, with the conveyance sensors 576 and 574, the number of the stacked sheets or the stacked sheet bundles obtained through the stapling, which are stacked onto the stacking trays 700 and 701, can be detected and counted. It is difficult to execute processing for detecting the number of stacked sheets after the sheets are stacked on the stacking tray. Therefore, in principle, the counting is performed at a timing of the delivery of the sheets. Based on the number of stacked sheets obtained as a result of such counting, the CPU 952 executes a first determination for determining whether or not additional sheets are allowed to be stacked onto the stacking tray 700 or 701. In this case, the CPU 952 functions as a first determination unit.

When the number of stacked sheets is not stored in a memory or storages of other types, or when the stored number of stacked sheets is deleted, for example, by shutdown, the first determination processing cannot be executed. In this embodiment, as described below, a nonvolatile memory is used as a storage unit. With this, at arbitrary time points including a time point after the activation from the power-off state, and a time point after restoration from the sleep mode, the first determination processing can be executed.

Further, based on the sheet surface height of the sheets stacked on the stacking tray 700 or 701, the CPU 952 executes a second determination processing for determining whether or not additional sheets are allowed to be stacked onto the stacking tray 700 or 701.

Detection of the sheet surface height (second detection) can be performed at an arbitrary time point, for example, with the sheet surface sensor 720. Thus, the CPU 952 is allowed to execute this second detection processing at the arbitrary time point. Based on results of the detection, the CPU 952 is allowed to execute the second determination processing for determining whether or not additional sheets are allowed to be stacked onto the stacking tray 700 or 701. In particular, at the arbitrary time points including the time point after the activation from the power-off state, and the time point after the restoration from the sleep mode, the second determination processing can be executed. In this case, the CPU 952 functions as a second determination unit.

(Block Diagram of Finisher)

Next, a configuration of the finisher controller 951 configured to control driving of the finisher 500 is described with reference to FIG. 5. FIG. 5 is a block diagram for illustrating the configuration of the finisher controller 951 of FIG. 2.

As illustrated in FIG. 5, the finisher controller 951 includes the CPU 952, a ROM 953, and a RAM 954 that is the nonvolatile memory capable of maintaining information even when the power is turned off. Via a communication IC (not shown), the finisher controller 951 communicates with the CPU circuit unit 900 installed on the image forming apparatus 10 side so as to perform data exchange therewith. With this, in response to instructions from the CPU circuit unit 900, the finisher controller 951 executes various programs stored in the ROM 953 to control driving of the finisher 500.

As various input devices and output devices, there are arranged an inlet motor M1 configured to drive the conveying roller pairs 511, 512, and 513 illustrated in FIG. 4, and the buffer motor M2 configured to drive the conveying roller pairs 514 and 519. Further, there are also arranged the delivery motor M3 configured to drive the conveying roller pairs 515, 516, 517, and 518, and the shift motor M4 configured to drive the shift unit 580. Still further, as members configured to drive various members of the processing tray 630, there are also arranged the bundle delivery motor M5 configured to drive the bundle delivery roller pair 680, the paddle motor M6 configured to drive the paddle 660, and the alignment motor M7 configured to drive the alignment member 641. Yet further, there are also arranged a stapler motor M8 configured to drive the stapler 601 that is configured to perform binding on a pile of sheets, and a stapler moving motor M9 configured to move the stapler 601 along an outer edge of the processing tray 630 and in the direction perpendicular to the conveying direction. In addition, in order to detect passage of sheets, signal output devices such as the conveyance sensors 570 to 576 are arranged.

Further, as input devices and output devices configured to raise and lower the stacking trays 700 and 701, there are arranged the tray raising-and-lowering motors M10 and M11, the sheet surface sensors 720 and 721, the over-stacking sensors 730 and 731, and the tray sheet presence/absence sensors 740 and 741.

In addition, there are arranged a buffer path switching solenoid SL1 configured to drive the switching flapper 540, and a delivery path switching solenoid SL2 configured to drive the switching flapper 541.

(Over-Stacking Detection Unit and Storage Unit)

Now, with reference to FIG. 6 to FIG. 9, an over-stacking detection unit and the storage unit are described in detail.

FIG. 6 is a diagram for illustrating details of over-stacking detection determination in the cases of plain sheets and thick sheets, and in the case of performing stapling on the plain sheets. FIG. 7 is an explanatory diagram for illustrating information to be stored in a case of the over-stacking. Herein, the sheets including the plain sheets and the thick sheets are collectively referred to as "sheets", and operations performed at the time when those sheets are stacked on the stacking tray 700 are described.

(1) Case of Plain Sheets

In the case of the plain sheets, the stack height of the sheets is detected to determine whether or not the over-stacking has occurred, that is, whether or not additional sheets are allowed to be stacked onto the stacking tray. Specifically, when the stacking tray 700 is lowered to the position of the over-stacking sensor 730, the finisher controller 951 determines that the stack height of the sheets has reached an upper limit stack height (300 [mm] in this embodiment). Then, the finisher controller 951 notifies the image forming apparatus 10 of the over-stacking.

At this time, as a flag indicating the over-stacking, the finisher controller 951 sets a value "1" to an address 1 of the RAM 954 illustrated in FIG. 7. With this, the result that the over-stacking has been detected based on the stack height of the sheets is stored as information.

(2) Case of Thick Sheets

In the case of the thick sheets, the over-stacking is detected based on the number of stacked sheets. The thick sheets are larger in the basis weight (heavier) than the plain sheets. Thus, when the thick sheets are stacked to the same upper limit height as that of the plain sheets, the stacking tray may be damaged due to overweight. In view of the above, in the case of the thick sheets, the number of the sheets stacked on the stacking tray is detected such that the over-stacking is detected at a position lower than that in the case of the plain sheets. Specifically, when the number of the sheets delivered on the stacking tray 700 reaches an upper limit number of stacked sheets (1,000 sheets in this embodiment), the image forming apparatus 10 is notified of the over-stacking.

At this time, as a flag indicating the over-stacking, the finisher controller 951 sets a value "2" to an address 1 of the RAM 954 illustrated in FIG. 7. With this, the result that the over-stacking has been detected based on the number of the stacked sheets is stored as information.

In the case of the thick sheets, at a time point when the number of stacked sheets reaches the upper limit number of stacked sheets, the stacking tray 700 has not yet been lowered to the position of the over-stacking sensor 730.

(3) Case where Plain Sheets are Selected and Stapling is Designated as Post-Processing When the stapling is performed as the post-processing on the plain sheets, the over-stacking is detected based on the number of sheet bundles formed through the stapling. The sheet bundles are each formed of a plurality of sheets. Thus, in this embodiment, the number of the stacked plain sheets is detected indirectly through the detection of the number of the sheet bundles. Specifically, when the number of the stapled bundles delivered on the stacking tray 700 reaches an upper limit number of stacked bundles (100 bundles in this embodiment), the image forming apparatus 10 is notified of the over-stacking.

At this time, the finisher controller 951 sets a value "3" to an address 1 of the RAM 954 illustrated in FIG. 7. With this, the result that the over-stacking has been detected based on the number of the sheet bundles is stored as information.

In the case of the stapling for the plain sheets, at a time point when the number of the stacked bundles reaches the upper limit number of stacked bundles, the stacking tray 700 has not yet been lowered to the position of the over-stacking sensor 730.

Figure 8:
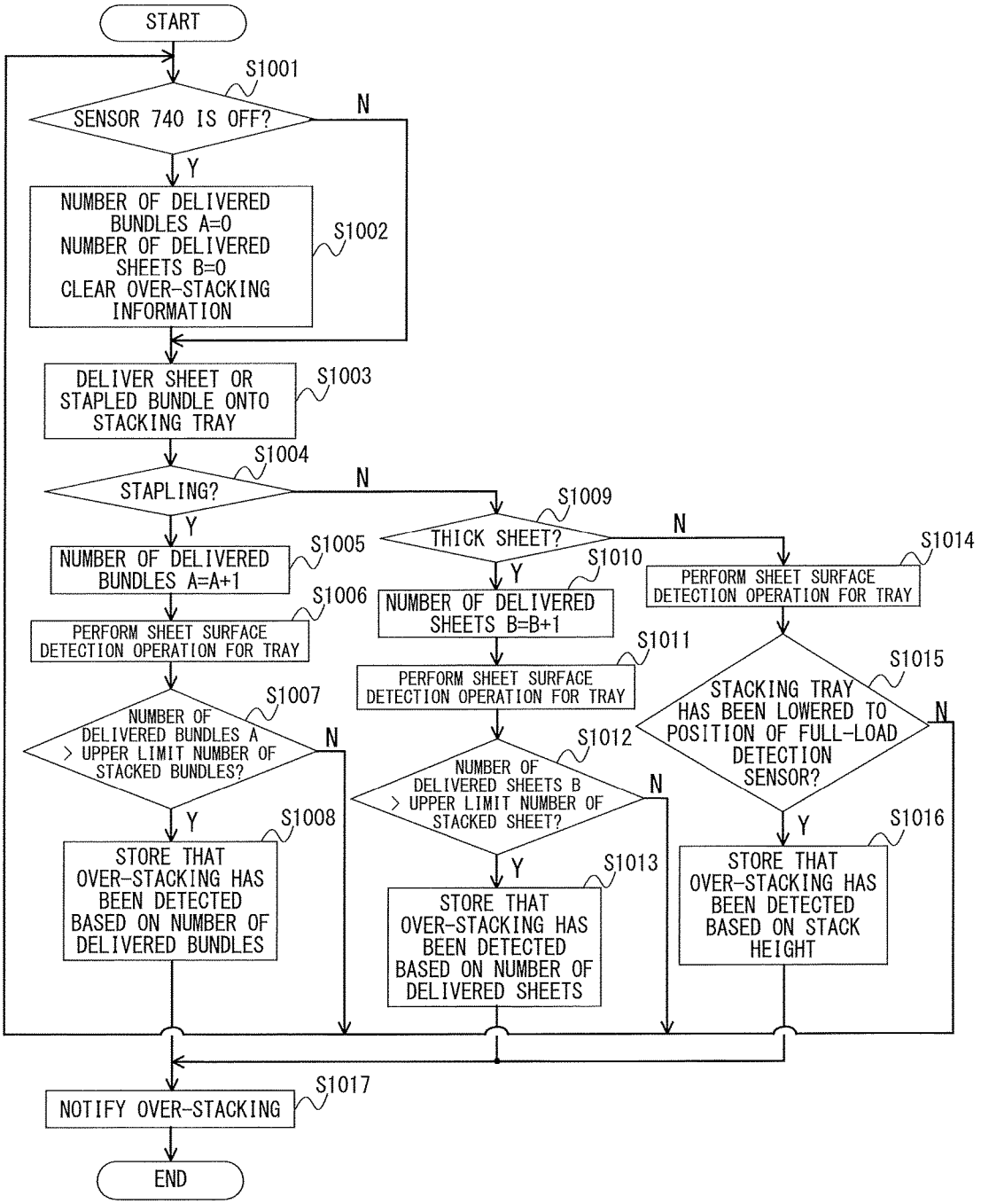
FIG. 8 is a flowchart for illustrating over-stacking detection determination.
Figure 9:
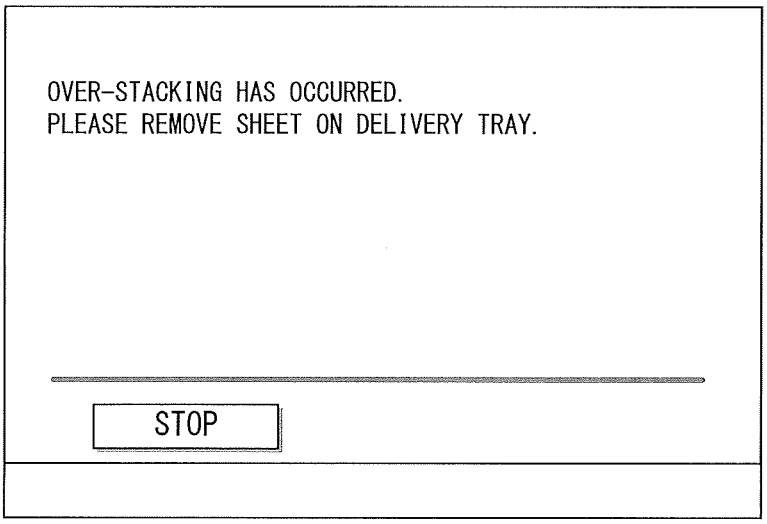
FIG. 9 is a view for illustrating a display screen in a case where the over-stacking is detected.

Next, with reference to FIG. 8 and FIG. 9, a flow of operations before the detection of the over-stacking is described. Note that, unless otherwise noted, the following operations are executed by the finisher controller 951, more specifically, by the CPU 952. As illustrated in FIG. 8, the CPU 952 determines whether or not the tray sheet presence/absence sensor 740 is in an OFF state. With this, it is determined whether or not sheets are stacked on the stacking tray 700 (Step S1001). When the CPU 952 determines in Step S1001 that the tray sheet presence/absence sensor 740 is in the OFF state (Step S1001: Y), the CPU 952 clears the number of delivered bundles A, the number of delivered sheets B, and over-stacking information in the RAM 954 (Step S1002). When a predetermined job is input to the image forming apparatus 10, the CPU 952 causes sheets to be delivered onto the stacking tray 700, or causes, depending on the job, sheet bundles subjected to stapling to be delivered onto the stacking tray 700 (Step S1003). Also in the case where the CPU 952 determines in Step S1001 that the tray sheet presence/absence sensor 740 is in an ON state (Step S1001: NO), the CPU 952 advances the processing to Step S1003.

After the sheets or the sheet bundles subjected to stapling are delivered onto the stacking tray 700 in Step S1003, the CPU 952 determines whether or not stapling is preset as the post-processing (Step S1004).

When the stapling is preset as the post-processing (Step S1004: Y), the CPU 952 increments the number of delivered bundles A to A+1 (Step S1005). After that, the CPU 952 performs the sheet surface detection operation on the tray described above (Step S1006), and causes the stacking tray 700 to be lowered.

Next, the CPU 952 executes processing for determining whether or not the number of delivered bundles A has exceeded the upper limit stacked bundle number (Step S1007). When the CPU 952 determines that the counted number of delivered bundles A has exceeded the upper limit number of stacked bundles (Step S1007: Y), the CPU 952 stores a result that the over-stacking is detected based on the number of the stapled sheet bundles into the RAM 954 (Step S1008). At this time, via a communication line (not shown), the CPU 952 notifies the CPU circuit unit 900 that the over-stacking has occurred (Step S1017). In response, the CPU circuit unit 900 displays, for example, a message of "OVER-STACKING HAS OCCURRED. PLEASE REMOVE SHEET ON STACKING TRAY." as illustrated in FIG. 9, or an instruction or an image (hereinafter, collectively referred to as "message") on the display device 400 of the image forming apparatus 10. Further, the CPU circuit unit 900 stops the job in the image forming apparatus 10 until the sheets are removed from the stacking tray 700.

When the CPU 952 determines in Step S1007 that the counted number of delivered bundles A has not yet exceeded the upper limit number of stacked bundles (Step S1007: NO), the CPU 952 returns the processing to Step S1001. In this way, the CPU 952 repetitively determines whether or not the tray sheet presence/absence sensor 740 is in the OFF state, and executes processing for, for example, performing subsequent stacking operations and determining whether or not the over-stacking has occurred.

Referring back to Step S1004, when the stapling is not preset as the post-processing (Step S1004: NO), the CPU 952 executes processing for determining whether or not the delivered sheets are the plain sheets or the thick sheets (Step S1009).

When the CPU 952 determines that the sheets are the thick sheets (Step S1009: Y), the CPU 952 increments the number of delivered sheets B to B+1 (Step S1010). Next, the CPU 952 performs the sheet surface detection operation for the tray described above (Step S1011), and performs the operation of lowering the stacking tray 700.

Next, the CPU 952 executes processing for determining whether or not the number of delivered sheets B has exceeded the upper limit number of stacked sheets (Step S1012).

When the CPU 952 determines that the counted number of delivered sheets B has exceeded the upper limit number of stacked sheets (Step S1012: Y), the CPU 952 stores a result that the over-stacking is detected based on the number of the delivered sheets into the RAM 954 (Step S1013). At this time, via the communication line (not shown), the CPU 952 notifies the CPU circuit unit 900 that the over-stacking has occurred (Step S1017).

In response, the message of FIG. 9 is displayed on the display device 400, and the job is stopped until the sheets are removed from the stacking tray 700.

Referring back to Step S1009, when the sheets are not the thick sheets (Step S1009: NO), the CPU 952 performs the sheet surface detection operation for the tray so as to perform the operation of lowering the stacking tray 700 (Step S1014).

The CPU 952 executes processing for determining whether or not the stacking tray 700 has been lowered to the position of the over-stacking sensor 730 (Step S1015). When the CPU 952 determines that the stacking tray 700 has been lowered to the position of the over-stacking sensor 730 (Step S1015: Y), the CPU 952 stores a result that the over-stacking is detected based on the stack height of the sheets into the RAM 954 (Step S1016). At this time, via the communication line (not shown), the CPU 952 notifies the CPU circuit unit 900 that the over-stacking has occurred (Step S1017). In response, the screen of FIG. 9 is displayed on the display device 400, and the job is stopped until the sheets are removed from the stacking tray 700.

Figure 10:
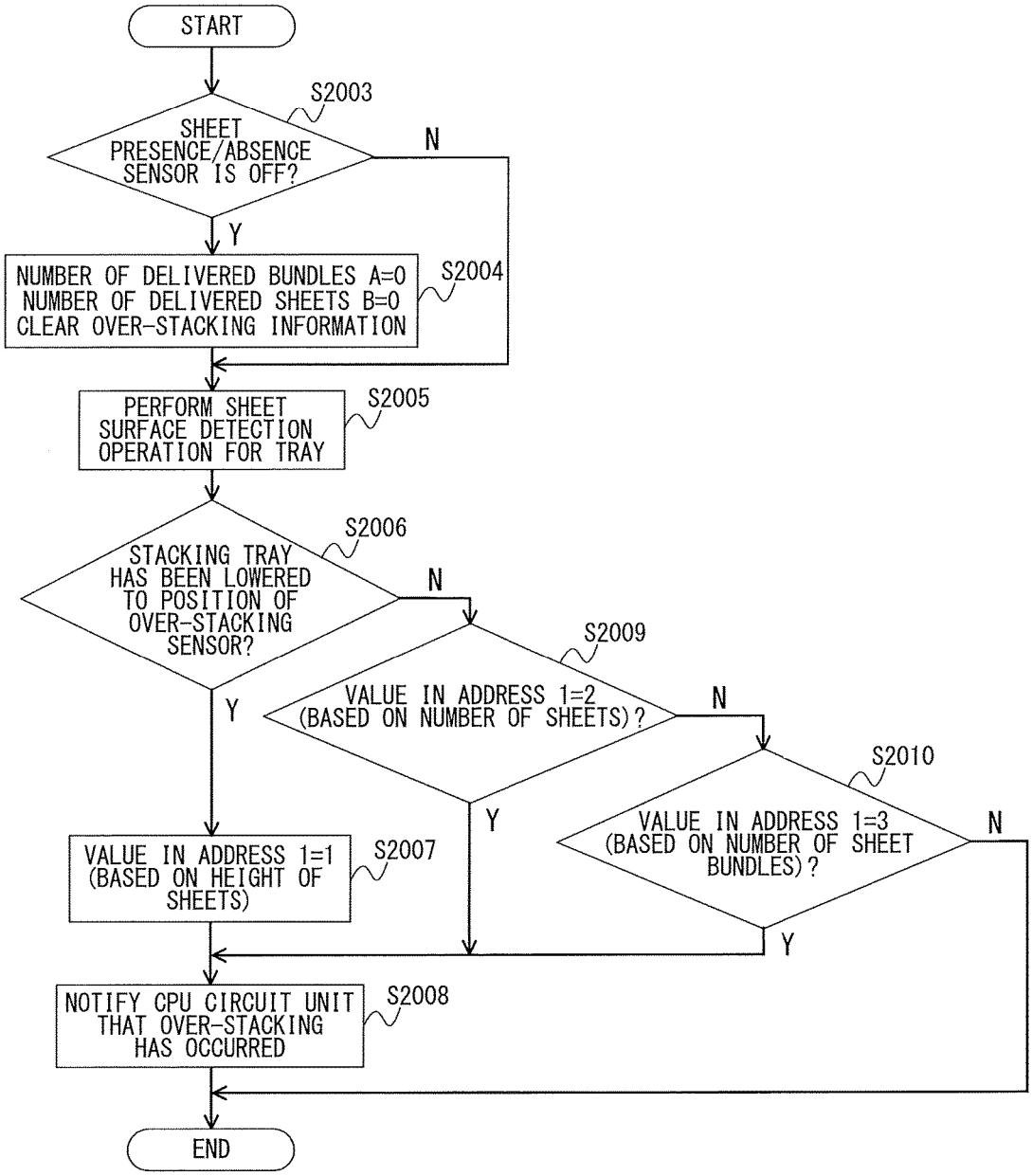
FIG. 10 is a flowchart for illustrating a control according to a first embodiment of the present invention.

Next, with reference to the flowchart of FIG. 10, a flow of over-stacking detection is described, which is performed based on the information stored in the storage unit and at the time of activation such as power OFF/ON and the restoration from the power-saving mode. Although the over-stacking detection performed with respect to the stacking tray 700 is described as an example, the following description is applicable also to the stacking tray 701.

When the image forming system 1 is activated or restored from the power-saving mode, the CPU 952 determines whether or not the tray sheet presence/absence sensor 740 is in an OFF state (Step S2003) before reception of a first sheet after the activation.

When the tray sheet presence/absence sensor 740 is in the OFF state (Step S2003: Y), there is no sheet on the stacking tray 700. Thus, the CPU 952 sets the number of delivered bundles A of the sheet bundles to zero and the number of delivered sheets B to zero, and clears the over-stacking information in the RAM 954 (Step S2004).

Next, the CPU 952 performs the sheet surface detection operation to the stacking tray 700 (Step S2005). Also in the case where the tray sheet presence/absence sensor 740 is not in the OFF state (Step S2003: NO), the CPU 952 advances the processing to Step S2005.

After completion of the sheet surface detection operation, the CPU 952 determines whether or not the stacking tray 700 has been lowered to the position of the over-stacking sensor 730 (Step S2006). When the CPU 952 determines that the stacking tray 700 has been lowered to the position of the over-stacking sensor 730 (Step S2006: Y), the CPU 952 stores the value "1" to the address 1 of the RAM 954 (Step S2007). In this way, the result that the over-stacking is detected based on the stack height of the sheets is expressed.

Via the communication line (not shown), the CPU 952 notifies the CPU circuit unit 900 that the over-stacking has occurred (Step S2008), and terminates the processing. At this time, the message illustrated in FIG. 9 is displayed on the display device 400 of the image forming apparatus 10, and delivery onto the stacking tray 700 is prohibited until the sheets are removed from the stacking tray 700.

Referring back to Step S2006, in a case where the stacking tray 700 has not yet been lowered to the position of the over-stacking sensor 730 (Step S2006: NO), the CPU 952 refers to the information stored in the address 1 of the RAM 954 to determine whether or not to notify of the over-stacking.

The CPU 952 determines whether or not the value stored in the address 1 of the RAM 954 is "2" to thereby determine whether or not the over-stacking has been detected based on the number of the delivered sheets (Step S2009).

When the value stored in the address 1 of the RAM 954 is "2" (Step S2009: Y), via the communication line (not shown), the CPU 952 notifies the CPU circuit unit 900 that the over-stacking has occurred (Step S2008). At this time, the description of FIG. 9 is displayed on the display device 400, and the delivery onto the stacking tray 700 is prohibited until the sheets are removed from the stacking tray 700. In this case, the information stored in the RAM 954 is not deleted, and the information is continuously stored.

When the value stored in the address 1 of the RAM 954 is not "2" (Step S2009: NO), the CPU 952 determines whether or not the value stored in the address 1 of the RAM 954 is "3" (Step S2010). The CPU 952 determines whether or not the value stored in the address 1 of the RAM 954 is "3" to thereby determine whether or not the over-stacking has been detected based on the number of the delivered bundles.

When the stored value is not "3" (Step S2010: NO), the CPU 952 terminates the processing. When the stored value is "3", via the communication line (not shown), the CPU 952 notifies the CPU circuit unit 900 that the over-stacking has occurred (Step S2008). At this time, the description of FIG. 9 is displayed on the display device 400, and the delivery onto the stacking tray 700 is prohibited until the sheets are removed from the stacking tray 700. In this case, the information stored in the RAM 954 is not deleted, and the information is continuously stored.

When all the determination results in Step S2006, Step S2009, and Step S2010 are "N", that is, when the over-stacking is not detected, the CPU 952 determines that the over-stacking has not occurred on the stacking tray 700, and terminates the detection process for detecting over-stacking.

As described above, in Step S2009 and Step S2010, before the image forming system 1 is activated or enters the power-saving mode, the CPU 952 refers to the information stored in the RAM 954. Not only the over-stacking detected based on the height of the sheets from the result of the sheet surface detection processing on the stacking tray 700, but also the over-stacking based on the number of the sheets and on the number of the bundles can also be reliably notified. With this, failures in stacking or malfunction of the stacking trays can be prevented.

Further, in this embodiment, the result that the over-stacking has been detected based on the stack height of the sheets, which is obtained in Step S1016 of FIG. 8 (and in Step S2007 of FIG. 10, which is described in detail below), is stored in the RAM 954.

However, the stack height of the sheets can be detected at arbitrary time points, for example, with the sheet surface sensor 720. Thus, the result that the over-stacking has been detected based on the stack height of the sheets need not be stored in the RAM 954.

Second Embodiment

In the first embodiment described above, whether or not the over-stacking has occurred is determined after the sheet surface detection operation to the tray is performed in Step S2005 of FIG. 10. However, this determination may be executed before the sheet surface detection operation.

Figure 11:
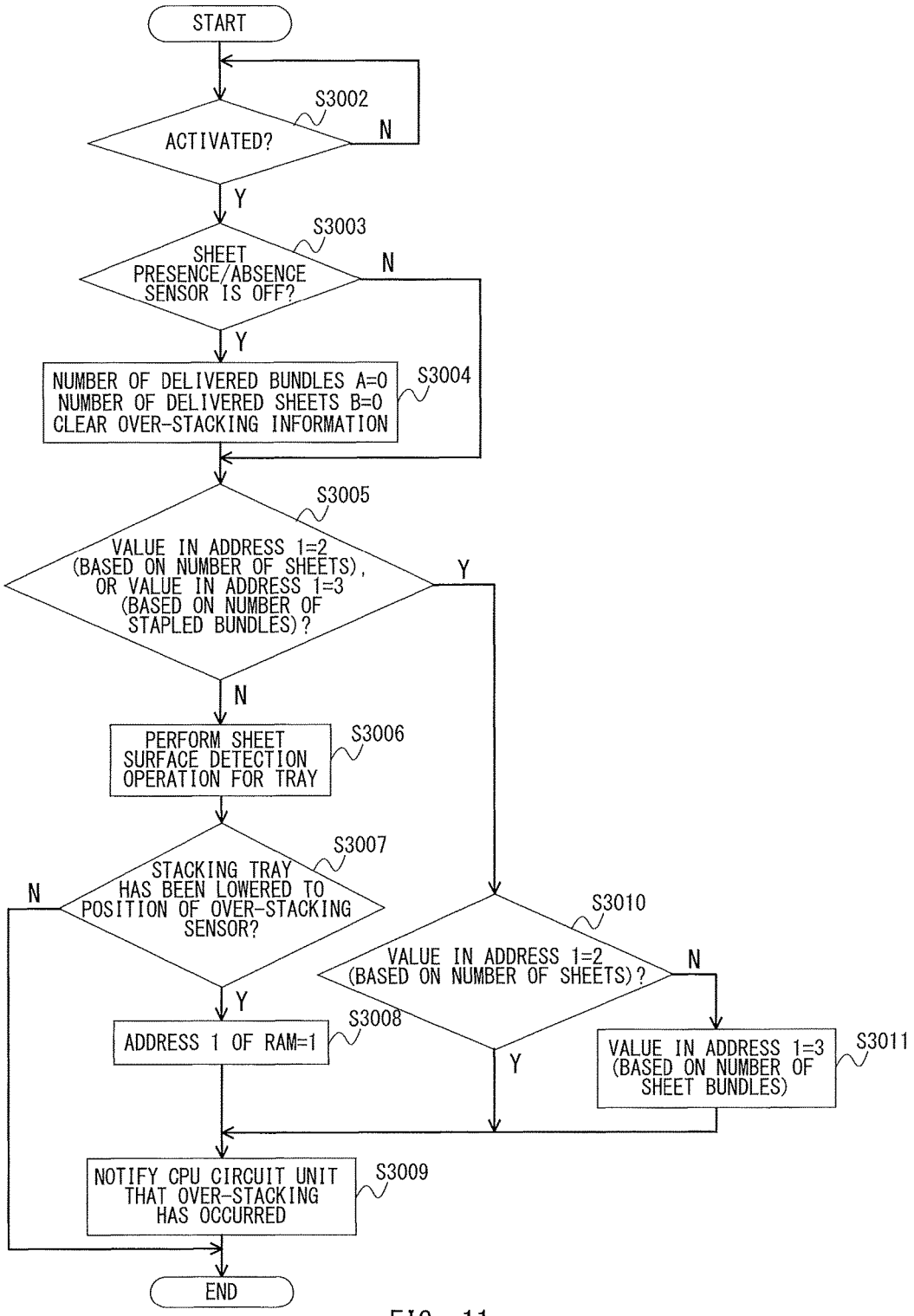
FIG. 11 is a flowchart for illustrating a control according to a second embodiment of the present invention.

FIG. 11 is a flowchart for illustrating a control according to a second embodiment of the present invention. As in FIG. 10, the control according to this embodiment is described with an example of the case where the sheets are stacked onto the stacking tray 700.

The CPU 952 determines whether or not the image forming system 1 has been activated in response to switching of the power from OFF to ON, or whether or not the image forming system 1 has been restored from the power-saving mode (Step S3002). When the CPU 952 determines that the image forming system 1 has not been activated or restored from the power-saving mode (Step S3002: NO), the CPU 952 executes Step S3002 again.

When the CPU 952 determines that the image forming system 1 has been activated or restored from the power-saving mode (Step S3002: Y), the CPU 952 determines whether or not the tray sheet presence/absence sensor 740 is in an OFF state (Step S3003).

When the tray sheet presence/absence sensor 740 is in the OFF state (Step S3003: Y), there is no sheet on the stacking tray 700. Thus, the CPU 952 sets the number of delivered bundles A of the sheet bundles to zero and the number of delivered sheets B to zero, and clears the over-stacking information in the RAM 954 (Step S3004).

Next, the CPU 952 determines whether or not the value "2" or "3" has been stored in the address 1 of the RAM 954. In other words, the CPU 952 determines based on which of the number of the sheets, the number of the stapled bundles, and other factors the over-stacking has been detected (Step S3005).

When the CPU 952 determines that the value in the RAM 954 is neither "2" nor "3" (Step S3005: NO), the CPU 952 performs the sheet surface detection operation to the stacking tray 700 (Step S3006). After that, the CPU 952 determines whether or not the stacking tray 700 has been lowered to the position of the over-stacking sensor 730 (Step S3007).

When the CPU 952 determines that the stacking tray 700 has been lowered to the position of the over-stacking sensor 730, the CPU 952 determines that the over-stacking has been detected based on the height of the stacked sheets, and stores the value "1" to the address 1 of the RAM 954 (S3008). Next, via the communication line (not shown), the CPU 952 notifies the CPU circuit unit 900 that the over-stacking has occurred (Step S3009). At this time, the message of FIG. 9 is displayed on the display device 400, and the delivery of the sheets onto the stacking tray 700 is prohibited until the sheets are removed from the stacking tray 700.

Meanwhile, when the CPU 952 determines in Step S3005 that the value in the RAM 954 is "2" or "3", the CPU 952 refers to the information stored in the RAM 954, and determines whether or not to notify the over-stacking (Step S3010).

When the value stored in the address 1 of the RAM 954 is "2" (Step S3010: Y), via the communication line (not shown), the CPU 952 notifies the CPU circuit unit 900 that the over-stacking has occurred. In this case, it is notified that the over-stacking has been detected based on the number of the delivered sheets. The message of FIG. 9 is displayed on the display device 400, and the delivery onto the stacking tray 700 is prohibited until the sheets are removed from the stacking tray 700. Further, at this time, the information stored in the RAM 954 is not deleted.

When the information stored in the RAM 954 is not the information indicating that the over-stacking has been detected based on the number of the delivered sheets (Step S3010: NO), the value stored in the address 1 of the RAM 954 is "3" (S3011). In this case, via the communication line (not shown), the CPU 952 notifies the CPU circuit unit 900 that the over-stacking has occurred. At this time, the message of FIG. 9 is displayed on the display device 400, and the delivery of the sheets onto the stacking tray 700 is prohibited until the sheets are removed from the stacking tray 700. Further, at this time, the information stored in the RAM 954 is not deleted.

When the over-stacking is not detected by the determinations in Step S3007, Step S3010, and Step S3011, the CPU 952 determines that the over-stacking has not occurred on the stacking tray 700, and terminates the detection process for detecting over-stacking.

As described above, in this embodiment, in Step S3010 and Step S3011, the CPU 952 refers to the information expressing the over-stacking, which is stored in the RAM 954 before the activation or the shift to the power-saving mode. With this, in addition to the over-stacking based on the sheet height, which is based on the results of the sheet surface detection processing on the stacking tray 700, the over-stacking based on the number of the sheets or the number of the sheet bundles can also be reliably detected.

With this, the CPU 952 can notify the CPU circuit unit 900 of the image forming apparatus 10 that the over-stacking has occurred. As a result, failures in stacking or malfunction of the stacking trays due to overweight can be prevented.

Further, also in the second embodiment, the result that the over-stacking has been detected based on the height of the stacked sheets is stored as the value "1" in the address 1 of the RAM 954 in Step S3008 of FIG. 11. However, the result that the over-stacking has been detected based on the height of the stacked sheets need not be stored in the RAM 954.

As described above, in the embodiments, when the over-stacking on the stacking tray is detected, which of the height of the sheets, the number of the delivered sheets, and the number of the delivered bundles is the basis for the determination that the over-stacking has occurred is stored. Then, at the time of the activation of the image forming system or the restoration from the power-saving mode, the CPU 952 refers to the stored determination reference for the over-stacking. Then, in accordance with the result of the reference, it is determined whether or not the over-stacking has occurred.

Specifically, when the over-stacking based on the height of the sheets is stored, the height of the sheets is detected preferably after an initialization operation to the stacking unit. With this, it is determined whether or not the over-stacking has occurred.

Meanwhile, when the over-stacking based on the number of the sheets or the number of the sheet bundles is stored, the initialization operation to the stacking unit is performed. After that, a determination that the over-stacking has occurred is made.

Through such a control, at the time of the activation or the restoration from the power-saving mode, erroneous detection of the over-stacking can be prevented. With this, failures in stacking or malfunction of the stacking trays can be prevented.

Further, according to the embodiments of the present invention, the number of the stacked sheets is detected and stored in the storage unit. Thus, at the time of the activation, based on the number of the stacked sheets, which is stored in the storage unit, it can be determined whether or not additional sheets are allowed to be stacked onto the stacking unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-154500, filed Aug. 4, 2015, which is hereby incorporated by reference wherein in its entirety.

What is claimed is:

1. A post-processing apparatus, which is to be connected to an image forming apparatus, the post-processing apparatus comprising:

a stacking tray configured to allow sheets received from the image forming apparatus to be stacked thereon;

a counter configured to count the number of the sheets stacked on the stacking tray;

a sheet detector configured to detect presence or absence of sheets stacked on the stacking tray;

a storage unit configured to store information, the storage unit holding the information even in a period during which power supply to the post-processing apparatus is turned off; and a controller configured to:

execute a first determination processing for determining whether or not an over-stacking state, in which additional sheets are not allowed to be stacked onto the stacking tray, has occurred, based on the a count value of the counter, and store, in a case where the count value exceeds a predetermined number, a first determination result indicating that the over-stacking state has occurred, in the storage unit, wherein the controller is configured to determine that the over-stacking state has occurred, in a case where the power supply to the post-processing apparatus is started, the sheet detector detects the presence of the sheets stacked on the stacking tray, and the first determination result has been stored in the storage unit.

2. The post-processing apparatus according to claim 1, wherein the storage unit comprises a nonvolatile memory.

3. The post-processing apparatus according to claim 1, further comprising a stapler configured to staple a plurality of the sheets, wherein a sheet bundle stapled by the stapler is stacked onto the stacking tray, and wherein the controller is configured to execute the first determination processing based on the number of the sheet bundles stacked on the stacking tray.

4. The post-processing apparatus according to claim 1, wherein the controller is configured to:

obtain a type of the sheets stacked on the stacking tray, execute the second determination processing, in a case where the obtained type of the sheets is a first type, and execute the first determination processing, in a case where the obtained type of the sheets is a second type having a larger basis weight than the first type.

5. The post-processing apparatus according to claim 1, wherein the controller is configured to determine that the over-stacking state has occurred, in a case where the post-processing apparatus is restored from a power saving mode, the sheet detector detects the presence of the sheets stacked on the stacking tray, and the first determination result has been stored in the storage unit.

6. The post-processing apparatus according to claim 1, further comprising a height detector configured to detect whether or not a height of the sheets stacked on the stacking tray reaches a predetermined height, wherein the controller is configured to:

execute a second determination processing for determining whether or not the over-stacking state has occurred, based on a detection result from the height detector, and store, in a case where the height of the sheets stacked on the stacking tray reaches the predetermined height, a second determination result indicating that the over-stacking state has occurred in the storage unit, and wherein, in a case where the power supply to the post-processing apparatus is started and the first determination result is not stored in the storage unit, the controller executes the second determination processing.

7. The post-processing apparatus according to claim 6, wherein the controller is configured to determine, irrespective of a result of the second determination processing, that the over-stacking state has occurred, in a case where the power supply to the post-processing apparatus is started, the sheet detector detects the presence of the sheets stacked on the stacking tray, and the first determination result has been stored in the storage unit.

8. The post-processing apparatus according to claim 6, further comprising a raising-and-lowering unit configured to raise and lower the stacking tray in accordance with an amount of the sheets stacked on the stacking tray, wherein the controller is configured to, in a case where the stacking tray is lowered to a predetermined position, determine, in the second determination processing, that the height of the sheets stacked on the stacking tray reaches the predetermined height.

9. The post-processing apparatus according to claim 6, wherein the controller is configured to be prevented from executing the second determination processing, in a case where the power supply to the post-processing apparatus is started and the first determination result has been stored in the storage unit.

10. The post-processing apparatus according to claim 6, wherein the controller executes, in a case where the power supply to the post-processing apparatus is started, the second determination processing, and wherein the controller is configured to be prevented from executing the first determination processing, in a case where, as a result of the second determination processing, the second determination result is stored in the storage unit.

11. An image forming system, comprising:

an image forming unit configured to form images onto sheets, a stacking tray configured to allow the sheets received from the image forming unit to be stacked thereon;

a counter configured to count the number of the sheets stacked on the stacking tray;

a sheet detector configured to detect presence or absence of sheets stacked on the stacking tray;

a storage unit configured to store information, the storage unit holding the information even in a period during which power supply to the image processing system is turned off; and a controller configured to:

execute a first determination processing for determining whether or not an over-stacking state, in which additional sheets are not allowed to be stacked onto the stacking tray, has occurred, based on a count value of the counter, and store, in a case where the count value exceeds a predetermined number, a first determination result indicating that the over-stacking state has occurred in the storage unit, wherein the controller is configured to determine that the over-stacking state has occurred, in a case where the power supply to the image processing system is started, the sheet detector detects the presence of the sheets stacked on the stacking tray, and the first determination result has been stored in the storage unit.

12. The image forming system according to claim 11, further comprising a display unit configured to display information, wherein the controller is configured to display a message of prompting the user to remove the sheets stacked on the stacking tray on the display unit, in a case of determining that the over-stacking state has occurred.

13. The image forming system according to claim 11, further comprising a height detector configured to detect whether or not a height of the sheets stacked on the stacking tray reaches a predetermined height, wherein the controller is configured to:

execute a second determination processing for determining whether or not the over-stacking state has occurred, based on a detection result from the height detector; and store, in a case where the height of the sheets stacked reaches the predetermined height, a second determination result indicating that the over-stacking state has occurred in the storage unit, and wherein, in a case where the power supply to the post-processing apparatus is started and the first determination result is not stored in the storage unit, the controller executes the second determination processing.

* * * * *